US007146316B2

(12) United States Patent
Alves

(10) Patent No.: US 7,146,316 B2
(45) Date of Patent: Dec. 5, 2006

(54) NOISE REDUCTION IN SUBBANDED SPEECH SIGNALS

(75) Inventor: Rogerio G. Alves, Troy, MI (US)

(73) Assignee: Clarity Technologies, Inc., Troy, MI (US)

( * ) Notice: Subject to any disclaimer, the term of this patent is extended or adjusted under 35 U.S.C. 154(b) by 839 days.

(21) Appl. No.: 10/272,921

(22) Filed: Oct. 17, 2002

(65) Prior Publication Data

US 2004/0078200 A1 Apr. 22, 2004

(51) Int. Cl.
*G10L 11/02* (2006.01)
*G10L 21/02* (2006.01)

(52) U.S. Cl. ..... 704/233; 704/227

(58) Field of Classification Search ..... 704/233, 704/227

See application file for complete search history.

(56) References Cited

U.S. PATENT DOCUMENTS 5,012,519 A * 4/1991 Adlersberg et al. ..... 704/226
5,276,765 A 1/1994 Freeman et al.
5,699,382 A 12/1997 Shoham et al.
5,749,067 A 5/1998 Barrett
5,768,473 A 6/1998 Eatwell et al.
5,963,901 A 10/1999 Vahatalo et al.
5,991,718 A 11/1999 Malah
6,035,048 A * 3/2000 Diethorn ..... 381/94.3
6,070,137 A 5/2000 Bloebaum et al.
6,098,040 A 8/2000 Petroni et al.
6,108,610 A 8/2000 Winn
6,175,634 B1 1/2001 Graumann
6,230,122 B1 * 5/2001 Wu et al. ..... 704/226
6,230,123 B1 5/2001 Mekuria et al.
6,591,234 B1 7/2003 Chandran et al.
6,604,071 B1 8/2003 Cox et al.
2002/0029141 A1 * 3/2002 Cox et al. ..... 704/220

OTHER PUBLICATIONS

Steven L. Gay et al., Acoustic Signal Processing for Telecommunication, Kluwer Academic Publishers, 2000, pp. 172-178.
Wargnier, James, Considerations for Robust Speech Recognition and Sound Quality for Automotive Handsfree Kits, Avios 2002, San Jose, CA pp. 1-11.

* cited by examiner

*Primary Examiner*—Tālivaldis Ivars Šmits
*Assistant Examiner*—Eunice Ng
(74) *Attorney, Agent, or Firm*—Brooks Kushman P.C.

(57) ABSTRACT

The presence of speech in a filtered speech signal is detected for the purpose of suspending noise level calculations during periods of speech. A received speech signal is split into a plurality of subband signals. A subband variable gain is determined for each subband based on an estimation of the noise level in the received voice signal and on an envelope of the received signal in each subband. Each subband signal is multiplied by the subband variable gain for that subband. The subband signals are combined to produce an output voice signal.

12 Claims, 5 Drawing Sheets

NOISE REDUCTION IN SUBBANDED SPEECH SIGNALS

BACKGROUND OF THE INVENTION

1. Field of the Invention

The present invention relates to reducing the level of noise in a speech signal.

2. Background Art

Electrical renditions of human speech are increasingly used for inter-person communication, storing speech and for man-machine interfaces. One limit on the comprehensibility of speech signals is the amount of noise intermixed with the speech. A wide variety of techniques have been proposed to reduce the amount of noise contained in speech signals. Many of these techniques are not practical because they assume information not readily available such as the noise characteristics, location of noise sources, precise speech characteristics, and the like.

One technique for reducing noise is to filter the noisy speech signal. This may be accomplished by converting the speech signal into its frequency domain equivalent, multiplying the frequency domain signal by the desired filter then converting back to a time domain signal. Converting between time domain and frequency domain representations is commonly accomplished using a fast Fourier transform and an inverse fast Fourier transform. Alternatively, the speech signal may be broken into subbands and a gain applied to each subband. The amplified or attenuated subbands are then combined to produce the filtered speech signal. In either case, filter or gain parameters must be calculated. This calculation depends upon determining characteristics of noise contaminating the speech signal.

Typically, speech contains quiet periods when only the noise component appears in the speech signal. Quiet periods occur naturally when the speaker pauses or takes a breath. A voice activity detector (VAD) may be used to detect the presence of speech in a speech signal. In use, a VAD is connected to the noisy speech signal. The output of the VAD signals parameter calculation logic when speech is occurring in the input signal. One problem with using a VAD is that the VAD is typically complex if the speech signal contains widely varying levels of noise.

What is needed is to produce improved speech signals in the presence of varying levels of noise without requiring complex logic for calculating noise reducing coefficients.

SUMMARY OF THE INVENTION

The present invention detects the presence of speech in a filtered speech signal for the purpose of suspending noise floor level calculations during periods of speech.

A method for reducing noise in a speech signal is provided. A noise floor in a received speech signal is estimated. The received speech signal is split into a plurality of subband signals. A subband variable gain is determined for each subband based on the noise floor estimation an on the subband signals. Each subband signal is multiplied by the subband variable gain for that subband. The scaled subband signals are combined to produce an output voice signal. The presence of speech is determined in a filtered voice signal. Noise floor estimation is suspended during periods when speech is determined to be present in the filtered voice signal.

The filtered voice signal may be the output voice signal. Alternatively, the filtered voice signal may be determined by multiplying each subband signal by a speech determination subband gain different from the corresponding subband variable gain. The product of the subband signal with a speech determination subband gain is combined to produce the filtered voice signal. This results in one path for enhanced speech and another, lower quality path for voice detection.

In an embodiment of the present invention, the method further includes decimation of each subband signal prior to multiplication by the subband variable gain and interpolation of the subband signal following multiplication by the subband variable gain.

In another embodiment of the present invention, each subband variable gain is determined as a ratio of a noisy speech level to the noise floor level. At least one of the noisy speech level and the noise floor level may be determined as a decaying average of levels expressed by a time constant. The time constant value may be based on a comparison of a previous level with a current level.

In yet another embodiment of the present invention, the method further includes determining a state based on the estimated noise floor. The subband variable gain is determined for each subband based on the determined state.

In still another embodiment of the present invention, each subband variable gain is determined as a ratio of a noisy speech level to a noise floor level. The noise floor level is determined as a decaying average of noise floor levels. Determination of the noise floor level is suspended during periods when speech is determined to be present in the filtered voice signal.

A system for reducing noise in an input speech signal is also provided. The system includes an analysis filter bank accepting the speech signal. The analysis filter bank includes a plurality of filters, each filter extracting a subband signal from the speech signal. The system also includes a plurality of variable gain multipliers. Each variable gain multiplier multiplies one subband signal by a subband variable gain to produce a subband product signal. A synthesizer accepts the subband product signals and generates a reduced noise speech signal. A voice activity detector detects the presence of speech in the reduced noise speech signal. Gain calculation logic determines a noise floor level based on the input speech signal if the presence of speech is not detected and holds the noise floor level constant if the presence of speech is detected. The subband variable gains are determined based on the noise floor level.

Another system for reducing noise in an input speech signal is provided. The system includes an analysis filter bank extracting subband signals from input speech signal. A variable gain multiplier for each subband multiplies the subband signal by a subband variable gain to produce a subband product signal. A speech signal synthesizer accepts the plurality of subband product signals and generates a reduced noise speech signal. The system also includes a plurality of speech detection multipliers. Each speech detection multiplier multiplies one subband signal by a speech detection subband gain to produce a detection subband signal. A voice detection synthesizer accepts the plurality of detection subband signals and generates a speech detection signal. A voice activity detector detects the presence of speech in the speech detection signal. Gain calculation logic generates the subband variable gains based on the detected presence of speech.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
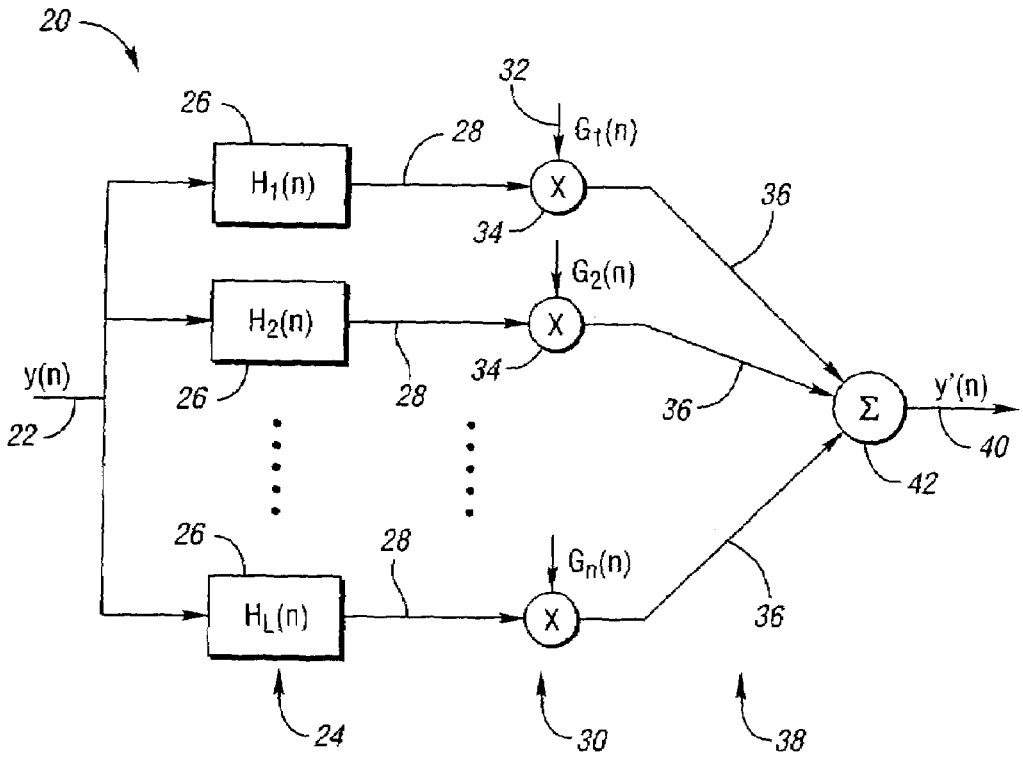
FIG. 1 is a block diagram illustrating analysis, subband gain and synthesis using a common sampling rate.

Referring to FIG. 1, a block diagram illustrating analysis, subband gain and synthesis using a common sampling rate is shown. A speech processing system, shown generally by 20, accepts input speech signal, y(n), indicated by 22. Analysis section 24 includes a plurality of subband filters 26 dividing input speech signal 22 into a plurality of subbands 28.

Subband filters 26 may be constructed in a variety of means as is known in the art. Subband filters 26 may be implemented as a uniform filter bank. Subband filters 26 may also be implemented as a wavelet filter bank, DFT filter bank, filter bank based on BARK scale, octave filter bank, and the like. The first subband filter 26, indicated by $H_1(n)$, may be a low pass filter or a band pass filter. The last subband filter, indicated by $H_L(n)$, may be a high pass filter or a band pass filter. Other subband filters 26 are typically band pass filters.

Subband signals 28 are received by gain section 30 modifying the gain of each subband 28 by a gain factor 32. Within each subband, multiplier 34 accepts subband signal 28 and gain 32 and generates product signal 36. As will be recognized by one of ordinary skill in the art, multiplier 34 may be implemented by a variety of means such as, for example, by a hardware multiplication circuit, by multiplication in software, by shift-and-add operations, with a transconductance amplifier, and the like.

Synthesis section 38 accepts product signal 36 and generates output voice signal y'(n) 40. In the embodiment shown, synthesis section 38 is implemented with summer 42. Synthesis section 38 may also be implemented with a synthesis filter bank to improve performance.

By properly selecting the number of subbands 28, frequency range of subband filters 26 and gains 32, the effect of noise in input speech signal 22 can be greatly reduced in output voice signal 40.

Figure 2:
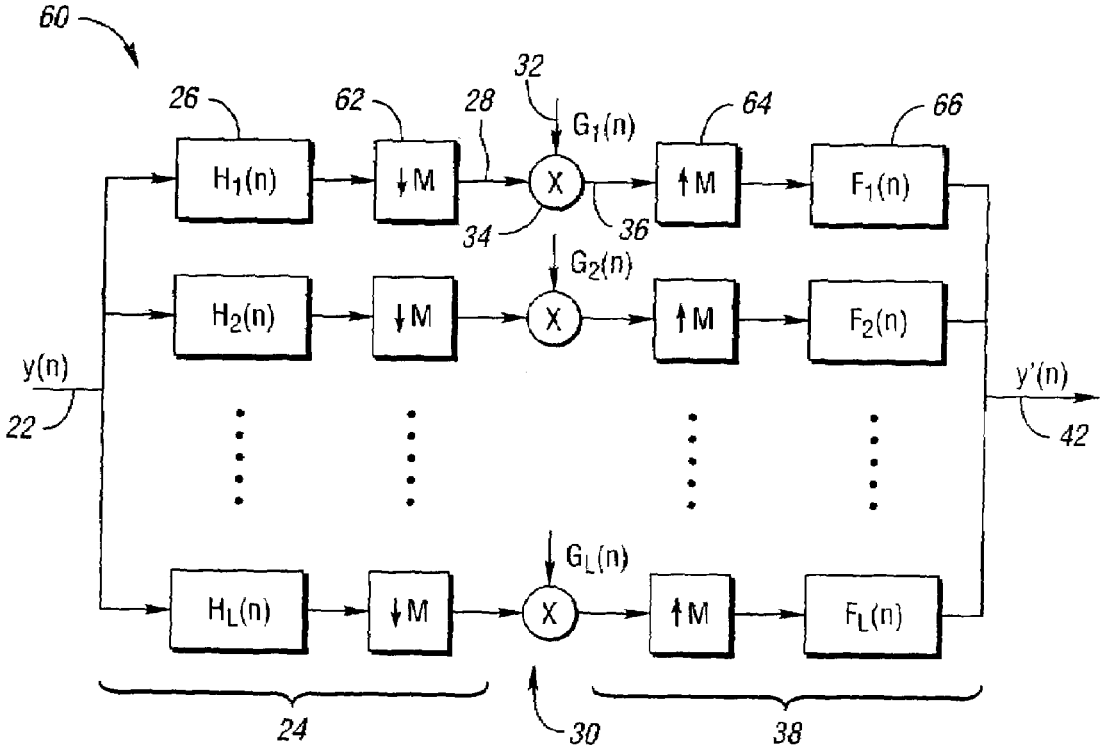
FIG. 2 is a block diagram illustrating analysis, subband gain and synthesis using different sampling rates.

Referring now to FIG. 2, a block diagram illustrating analysis, subband gain and synthesis using different sampling rates is shown. Speech processing system 60 has analysis section 24 with decimator 62 for each subband. Decimator 62 implements decimation, or down sampling, by a factor of M. Synthesis section 38 then includes interpolator 64 implementing interpolation, or up sampling, by factor M. The output of interpolator 64 is filtered by reconstruction filter 66. Speech processing system 60 may be non-critically sampled or critically sampled. If sampling factor M equals the number of subbands, L, then speech processing system 60 is critically sampled. If the sampling factor is less than the number of subbands, speech processing system 60 is non-critically sampled. Subband filters 26, 66 can be obtained using a modulated version of a prototype filter. Generally, this type of structure uses uniform filters. If a non-uniform filter bank is used such as, for example, wavelet filters, then different up sampling factors and down sampling factors are needed.

A synthesis/analysis system without decimation, as shown in FIG. 1, typically presents better speech quality than a system with decimation, as in FIG. 2, due to the fact that small distortions are introduced in a decimation system from subband aliasing. However, decimation may reduce the complexity of the system. The decision as to whether or not decimation will be used is dependant on the application constraints.

Figure 3:
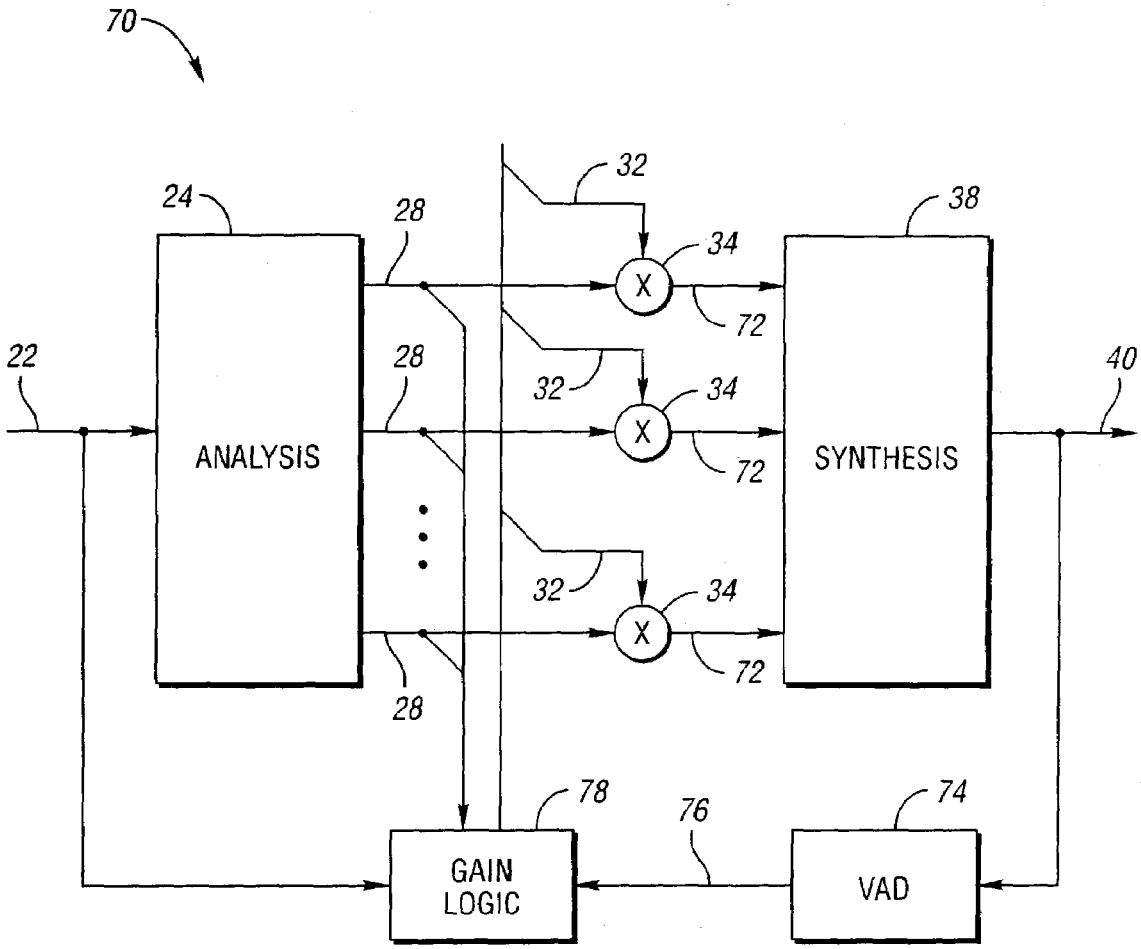
FIG. 3 is a block diagram illustrating noise reduction according to an embodiment of the present invention.

Referring now to FIG. 3, a block diagram illustrating noise reduction according to an embodiment of the present invention is shown. Speech processing system 70 includes analysis section 24 accepting input speech signal 22 and producing a plurality of speech subband signals 28. Speech processing system 70 also includes a plurality of variable gain multipliers 34. Each multiplier 34 multiplies one subband signal 28 by a subband variable gain 32 to produce a subband product signal 72. Synthesizer 38 accepts subband product signals 72 and generates reduced noise speech signal 40. Voice activity detector (VAD) 74 detects the presence of speech in reduced noise speech signal 40. VAD 74 generates voice activity signal 76 indicating the presence of speech. Gain calculation logic 78 calculates subband variable gains 32. Gain logic 78 determines a noise floor level based on input speech signal 22 if the presence of speech is not detected and holds the noise floor level constant if the presence of speech is detected. Subband variable gains 32 are determined based on the noise floor level and speech level in each subband.

Preferably, variable gain 32 is calculated for the $k^{th}$ subband using the envelope of the subband noisy speech signal, $Y_k(n)$, and subband noise floor envelope, $V_k(n)$. Equation 1 provides a formula for obtaining the envelope of subband signal 28 where $|y_k(n)|$ represents the absolute value of subband signal 28.

$$Y_k(n)=\alpha Y_k(n-1)+(1-\alpha)|y_k(n) \tag{1}$$

The constant, α, is defined as shown in Equation 2:

$$\alpha = e^{-\frac{f_s}{M}\cdot \text{speech_decay}}, \tag{2}$$

where $f_s$ represents the sampling frequency of input speech signal 22, M is the down sampling factor, and speech_decay is a time constant that determines the decay time of the speech envelope. The initial value $Y_k(0)$ is set to zero. Similarly, the noise floor envelope may be expressed as in Equation 3:

$$V_k(n)=\beta V_k(n-1)+(1-\beta)|y_k(n)|. \tag{3}$$

The constant, β, is defined as shown in Equation 4:

$$\beta = e^{-\frac{f_s}{M}\cdot \text{noise_decay}}, \tag{4}$$

where noise_decay is a time constant that determines the decay time of the noise envelope.

The constants α and β can be implemented to allow different attack and decay time constants, as indicated in Equations 5 and 6:

$$\alpha = \begin{cases} \alpha_a & \text{for } |y_k(n)| \geq Y_k(n-1) \\ \alpha_d & \text{for } |y_k(n)| < Y_k(n-1) \end{cases} \tag{5}$$

and $$\beta = \begin{cases} \beta_a & \text{for } |y_k(n)| \geq V_k(n-1) \\ \beta_d & \text{for } |y_k(n)| < V_k(n-1) \end{cases} \tag{6}$$

where the subscript "a" indicates the attack time constant and the subscript "d" indicates the decay time constant. Example parameters are:

speech_attack ($\alpha_a$)=0.001 s,
speech_decay ($\alpha_d$)=0.010 s,
noise_attack ($\beta_a$)=4.0 s, and
noise_decay ($\beta_d$)=1.0 s.

Once the values of $Y_k(n)$ and $V_k(n)$ have been obtained, variable gain 32 for each subband may be computed as in Equation 7:

$$G_k(n) = \frac{Y_k(n)}{\gamma V_k(n)}, \tag{7}$$

where the constant, γ, provides an estimate of the noise reduction. For example, if the speech and noise envelopes have approximately the same value as may occur, for example, during periods of silence, the gain factor becomes:

$$G_k(n) \approx \frac{1}{\gamma} \tag{8}$$

Thus, if γ=10, the noise reduction will be approximately 20 dB. In an embodiment of the present invention, values for gamma may be based on noise characteristics such as, for example, the level of noise in input speech signal 22. Also, a different gain factor, $\gamma_k$, may be used for each subband k. Typically, variable gain 32 is limited to magnitudes of one or less.

Voice activity detector 74 may be implemented in a variety of manners as is known in the art. One difficulty with voice activity detectors commonly in use is that such detectors require complex logic in the presence of high or medium levels of noise. VAD 74 monitors output speech signal 40 for the presence of speech. Since much of the noise intermixed with input speech signal 22 has already been removed, the design of VAD 74 may be much simpler than if VAD 74 monitored input speech signal 22. One implementation of VAD 74 detects the presence of speech by examining the power in output speech signal 40. If the power level is above a preset threshold, speech is detected.

In another embodiment, VAD 74 may detect the presence of speech in output speech signal 40 by obtaining a signal-to-noise ratio. For example, the ratio of an output speech level envelope to an output noise floor estimation may be used, as shown in Equation 9:

$$VAD = \begin{cases} 1 & \text{for } \frac{Y'(n)}{V'(n)} > T \\ 0 & \text{otherwise} \end{cases}, \tag{9}$$

where T is a threshold value and VAD is voice activity signal 76. Speech level envelope, Y'(n), and noise floor level envelope, V'(n), may be calculated as described above with regards to Equations 1–6. The threshold T may be chosen based on the noise floor estimation of the input signal. Hysteresis may also be used with the threshold.

Problems can occur in a noise reduction system if voice is present in any subband signal 28 for an extended period of time. This problem can occur in continuous speech, which may be more common in certain languages and in signals from certain speakers. Continuous speech causes the noise floor ceiling envelope to grow. As a result, the gain factor for each subband, $G_k(n)$, will be smaller than it should be, resulting in an undesirable attenuation in processed speech signal 40. This problem can be reduced if the update of the noise envelope floor estimation is halted during speech periods. In other words, when voice activity signal 76 is asserted, the value of $V_k(n)$ is not updated. This operation is described in Equation 10 as follows:

$$V_k(n) = \begin{cases} \beta V_k(n-1) + (1-\beta)|y_k(n)|, & \text{If } VAD = 0 \\ V_k(n-1), & \text{If } VAD = 1 \end{cases}. \tag{10}$$

Figure 4:
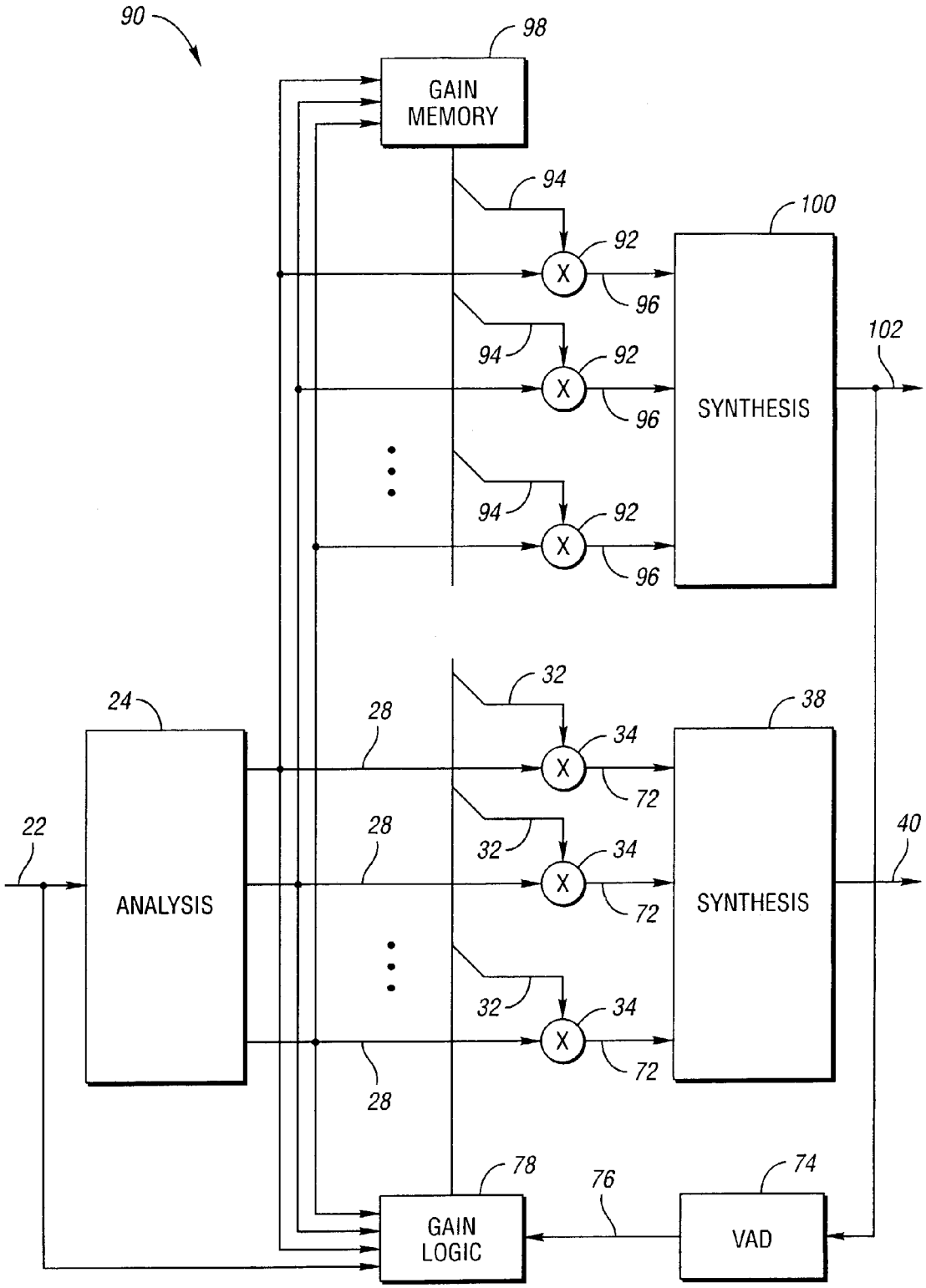
FIG. 4 is a block diagram illustrating noise reduction with separate synthesis according to an embodiment of the present invention.

Referring now to FIG. 4, a block diagram illustrating noise reduction with separate synthesis according to an embodiment of the present invention is shown. A speech processing system, shown generally by 90, includes analysis filter bank 24 extracting a plurality of subband signals 28 from input speech signal 22. Each variable gain multiplier 34 multiplies one subband signal 28 by subband variable gain 32 to produce subband product signal 72. Speech signal synthesizer 38 accepts subband product signals 72 and generates a reduced noise speech signal 40. Speech processing system 90 also includes a plurality of speech detection multipliers 92. Each speech detection multiplier 92 multiplies one subband signal 28 by speech detection subband gain 94 to produce detection subband signal 96. Speech detection subband gains 94 may be calculated or preset and may be held in gain memory 98. Voice detection synthesizer 100 accepts detection subband signals 96 and generates speech detection signal 102. Voice activity detector 74 detects the presence of speech in speech detection signal 102. Gain calculation logic 78 generates subband variable gains 32 based on the detected presence of speech.

Separate analysis sections for generating speech detection signal 102 and for generating reduced noise speech signal 40 permits different characteristics to be used for each. For example, speech detection subband gains 94 may be different than subband variable gains 32 to better suit the task of detecting speech. Also, speech detection subband gains 94 and detection multipliers 92 may have different, typically lower, resolution requirements than subband variable gains 32 and variable gain multipliers 34.

Figure 5:
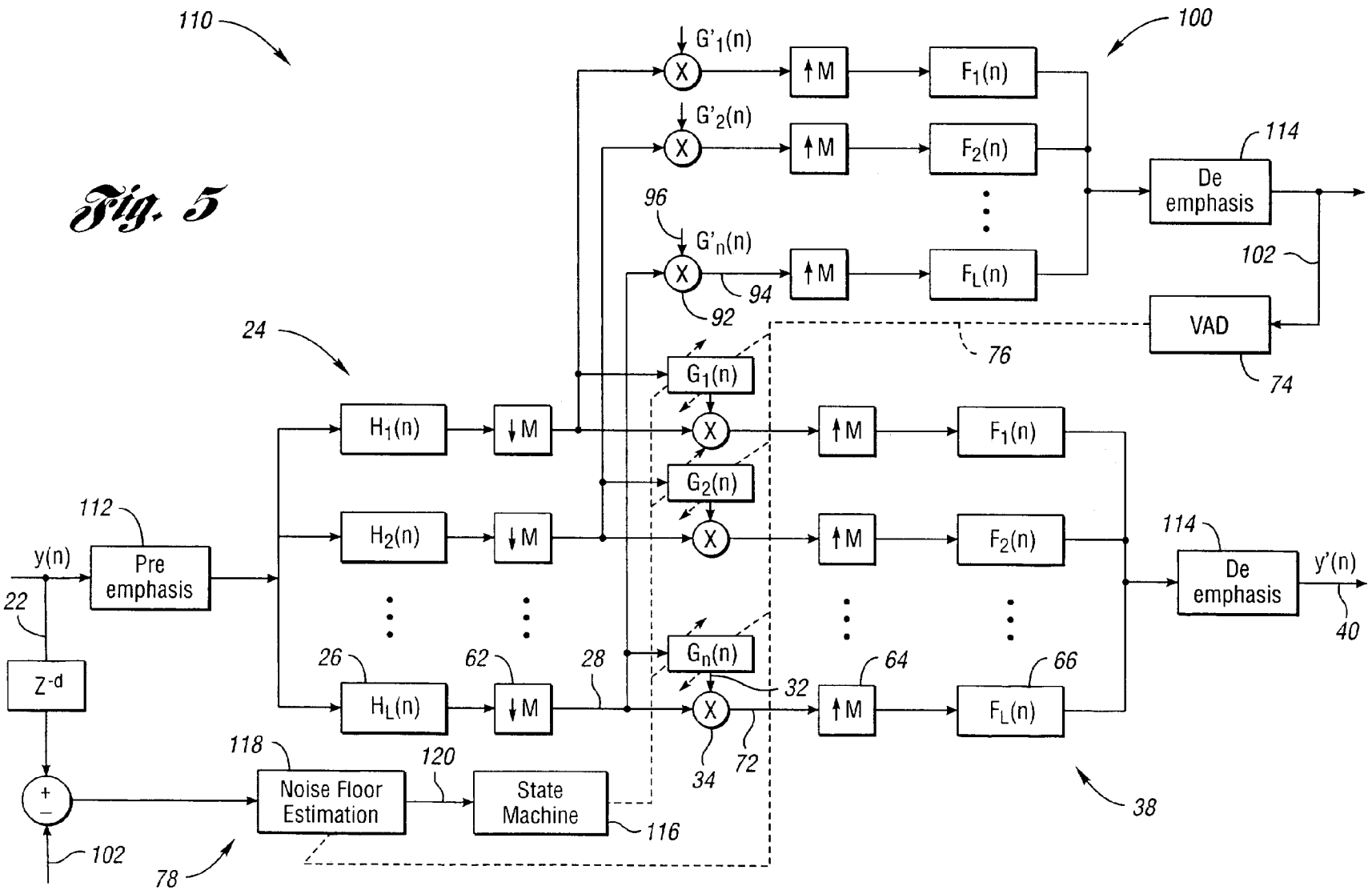
FIG. 5 is a detailed block diagram of an embodiment of the present invention.

Referring now to FIG. 5, a detailed block diagram of an embodiment of the present invention is shown. A speech processing system, shown generally by 110, includes analysis section 24, speech signal synthesis section 38 and voice detection synthesis section 100. Speech processing system 110 also includes preemphasis filter 112 and deemphasis filters 114. Typically, the lower formants of input speech signal 22 contain more energy than higher formants. Also, noise information in high frequencies is less prominent than speech information in high frequencies of input speech signal 22. Therefore, preemphasis filter 112 inserted before the noise cancellation process will help to obtain better noise reduction in high frequency bands. A simple preemphasis filter can be described as in Equation 11:

$$\hat{y}(n)=y(n)-a_1\cdot\hat{y}(n-1) \tag{11}$$

where $\hat{y}(n)$ is the output of preemphasis filter 112 and the constant $a_1$ is typically between 0.96 and 0.99. Deemphasis filter 114 removes the effects of preemphasis filter 112. A corresponding deemphasis filter 114 may be described by Equation 12:

$$y'(n)=\tilde{y}(n)-a_1\cdot y'(n-1) \tag{12}$$

where $\tilde{y}(n)$ is the input to deemphasis filter 114. If necessary, more complex structures may be used to implement preemphasis filter 112 and deemphasis filter 114.

In real world applications, the characteristic of noise can change at any time. Further, the level of noise may vary widely from low noise conditions to high noise conditions. Differing noise conditions may be used to trigger different sets of parameters for calculating variable gains 32. Inappropriate selection of parameters may actually degrade performance of speech processing system 110. For example, in low noise conditions, an aggressive set of gain parameters may result in undesirable speech distortion in output speech signal 40.

Gain logic 78 may include state machine 116 and noise floor estimator 118 for determining gain calculation parameters. Fullband noise estimation 120 is obtained by subtracting delayed input signal 22 from filtered speech signal 102. This results in an amount of noise, extracted from noisy input 22, used by noise floor estimator 118 to generate an estimation of the noise floor present in input signal 22. The amount of delay, d, applied to input 22 compensates for the delay created by the subband structure. The noise floor estimation will only be updated during periods of no speech in order to improve the estimation process. Noise floor estimator may be described by Equation 13 as follows:

$$V(n)=\begin{cases}\beta V(n-1)+(1-\beta)|y(n)| & \text{if } VAD=0\\ V(n-1) & \text{if } VAD=1\end{cases} \tag{13}$$

where V(n) is the envelope of extracted noise signal 120.

State machine 116 changes to one of P states based on noise floor signal 120 and thresholds $T_1, T_2, \ldots, T_p$, as follows:

$$\begin{aligned}&\text{State_1, if } 0<V(n)<T_1\\ &\text{State_2, if } T_1<V(n)<T_2\\ &\vdots\end{aligned} \tag{14}$$

-continued $$\begin{aligned}&\text{State_p, if } T_{p-1}<V(n)<T_p\\ &\vdots\\ &\text{State_P, if } T_{P-1}<V(n)<T_P\end{aligned}$$

For each state p, different parameters such as γ, β, α, and the like, can be used in calculating gains 32. This allows more aggressive noise cancellation in higher levels of noise and less aggressive, less distorting noise cancellation during periods of low noise. In addition, hysteresis may be used in state transitions to prevent rapid fluctuations between states.

Figure 6:
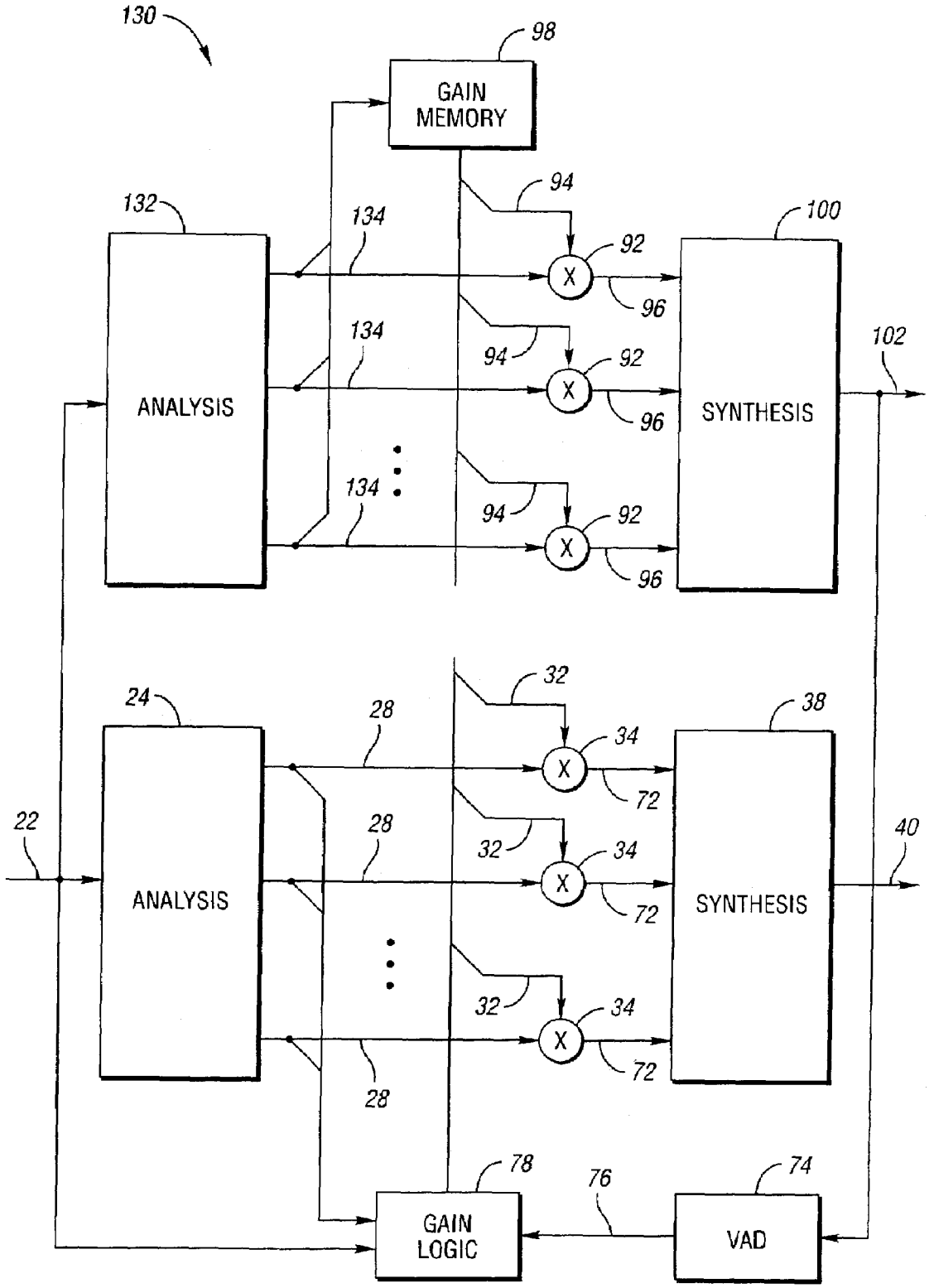
FIG. 6 is a block diagram illustrating noise reduction with separate analysis and synthesis according to an embodiment of the present invention.

Referring now to FIG. 6, a block diagram illustrating noise reduction with separate analysis and synthesis according to an embodiment of the present invention is shown. A speech processing system, shown generally by 130, includes voice detection analysis section 132 separate from analysis section 24. Speech detection analysis section 132 accepts input speech signal 22 and generates subbands 134. Separate analysis section 132 permits a different number of subband signals 134 to be generated for forming speech detection signal 102. Alternatively, or in addition to a different number of subband signals 134, analysis section 132 may also generate subband signals 134 having different characteristics than subband signals 28. These characteristics may include signal resolution, range, sampling rate, and the like. Thus, voice detection synthesizer section 100 and multipliers 92 may be of a simpler construction for generating speech detection signal 102.

With reference to the above FIGS. 1–6, block diagrams have been used to logically illustrate the present invention. These block diagrams may be implemented in a variety of means, such as software running on a computing system, custom integrated circuitry, discrete digital components, analog electronics, and various combinations of these and other means. Block diagrams have been provided for ease of illustration and understanding, and are not meant to limit the present invention to a particular implementation.

Figure 7:
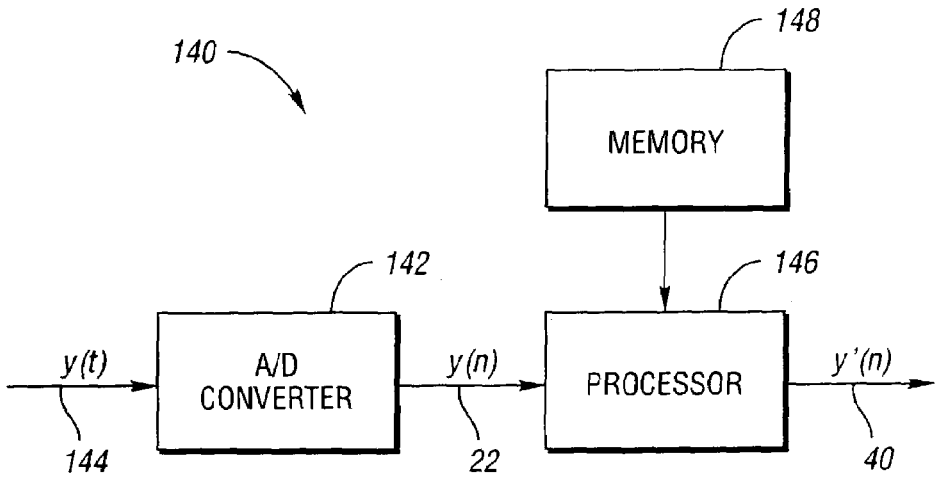
FIG. 7 is a block diagram of a system for implementing noise reduction according to an embodiment of the present invention.

Referring now to FIG. 7, a block diagram of a system for implementing noise reduction according to an embodiment of the present invention is shown. A speech processing system, shown generally by 140, includes analogue-to-digital converter 142 accepting continuous time speech input signal 144 and producing speech input signal 22. Processor 146 processes input speech signal 22 to produce output speech signal 40. Memory 148 supplies instructions and constants to processor 146. As will be recognized by one of ordinary skill in the art, some or all of the logic indicated in FIGS. 1–6 may be implemented as code executing on processor 146.

While embodiments of the invention have been illustrated and described, it is not intended that these embodiments illustrate and describe all possible forms of the invention. Words used in this specification are words of description rather than limitation, and it is understood that various changes may be made without departing from the spirit and scope of the invention.

What is claimed is:

1. A system for reducing noise in an input speech signal, the input speech signal including intermittent speech in the presence of noise, the system comprising:

an analysis filter bank accepting the input speech signal, the analysis filter bank comprising a plurality of filters, each filter in the analysis filter bank extracting a subband signal from the speech signal;

a first plurality of variable gain multipliers, each first variable gain multiplier multiplying one subband signal by a first subband variable gain to produce a subband product signal;

a synthesizer accepting the plurality of subband product signals and generating a reduced noise speech signal;

a second plurality of variable gain multipliers, each second variable gain multiplier multiplying one subband signal by a second gain different than the corresponding first subband variable gain;

a voice activity detector detecting the presence of speech in the reduced noise speech signal; and gain calculation logic for calculating the first subband variable gains, the gain calculation logic operative to:

(a) determine a noise floor level based on the input speech signal if the presence of speech is not detected, (b) hold the noise floor level constant if the presence of speech is detected, and (c) determine the first subband variable gains based on the noise floor level.

2. A system for reducing noise in an input speech signal as in claim 1 wherein the gain calculation logic comprises a state machine changing states based on an amount of noise extracted from the input speech signal, the first subband variable gains further based on the state of the state machine.

3. A system for reducing noise in an input speech signal as in claim 1 wherein the analysis filter bank comprises a decimator for each subband and wherein the synthesizer comprises an interpolator for each subband.

4. A system for reducing noise in an input speech signal, the input speech signal including intermittent speech in the presence of noise, the system comprising:

an analysis filter bank accepting the input speech signal, the analysis filter bank comprising a plurality of filters, each filter in the analysis filter bank extracting a subband signal from the input speech signal;

a plurality of variable gain multipliers, each variable gain multiplier multiplying one subband signal by a subband variable gain to produce a subband product signal;

a speech signal synthesizer accepting the plurality of subband product signals and generating a reduced noise speech signal;

a plurality of speech detection multipliers, each speech detection multiplier multiplying one subband signal by a speech detection subband gain to produce a detection subband signal having reduced noise content;

a speech detection synthesizer accepting the plurality of detection subband signals and generating a speech detection signal;

a voice activity detector detecting the presence of speech in the speech detection signal; and gain calculation logic generating the subband variable gains based on the detected presence of speech.

5. A system for reducing noise in an input speech signal as in claim 4 wherein the subband variable gain for each subband is based on a ratio of an input speech envelope level to a noise floor envelope level, the noise floor envelope level based on the detected presence of speech.

6. A system for reducing noise in an input speech signal as in claim 5 wherein the noise floor envelope level remains constant during a period of detected speech.

7. A system for reducing noise in an input speech signal as in claim 4 wherein the gain calculation logic comprises a state machine changing states based on a level of noise detected in the input speech signal, the subband variable gains further based on the state of the state machine.

8. A system for reducing noise in an input speech signal as in claim 4 wherein the analysis filter bank comprises a decimator for each subband and wherein the speech signal synthesizer and the voice detection synthesizer each comprises an interpolator for each subband.

9. A method of processing a speech signal, the speech signal including intermittent speech in the presence of noise, the method comprising:

dividing the speech signal into subbands;

multiplying each subband of the speech signal by a subband variable gain;

multiplying each subband of the speech signal by a speech detection subband gain to generate a detection speech signal;

detecting speech present in the detection speech signal; and determining each subband variable gain based on the speech signal and on the detected presence of speech.

10. A system for processing a speech signal comprising:

means for dividing the speech signal into at least one set of subbands;

means for amplifying each subband from a first set of subbands to produce a plurality of filtered first set subbands;

means for combining the plurality of filtered first set subbands to produce a first filtered speech signal;

means for determining the presence of speech based in the first filtered speech signal;

means for amplifying each subband from a second set of subbands to produce a plurality of filtered second set subbands, each subband from the second set of subbands amplified by one of a plurality of variable gains;

means for combining the plurality of filtered second set subbands to produce a second filtered speech signal; and means for determining the variable gains based on the detected presence of speech and on the speech signal.

11. A system for processing a speech signal as in claim 10 wherein the first set of subbands is the same as the second set of subbands.

12. A system for processing a speech signal as in claim 10 wherein the first set of subbands is not the same as the second set of subbands.

* * * * *